US006283217B1

(12) United States Patent
Deaton

(10) Patent No.: US 6,283,217 B1
(45) Date of Patent: Sep. 4, 2001

(54) AXIAL EQUALIZING VALVE

(75) Inventor: Thomas M. Deaton, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/363,193

(22) Filed: Jul. 29, 1999

Related U.S. Application Data

(60) Provisional application No. 60/095,585, filed on Aug. 6, 1998.

(51) Int. Cl.[7] ..... E21B 34/14

(52) U.S. Cl. ..... 166/332.7; 166/324; 166/325; 166/374

(58) Field of Search ..... 166/386, 374, 166/375, 383, 324, 325, 332.7, 332.8; 251/53, 58, 147, 303, 75, 80, 62; 137/629

(56) References Cited

U.S. PATENT DOCUMENTS

| | | |
|---|---|---|
| 19,013 | 1/1858 | Carr . |
| 709,262 | 9/1902 | Gold . |
| 1,655,729 | 1/1928 | Jones . |
| 1,783,621 | 12/1930 | Johnson . |
| 1,807,970 | 6/1931 | Davis . |
| 1,998,913 | 4/1935 | Wheaton . |
| 2,812,821 | 11/1957 | Nelson . |
| 2,839,082 | 6/1958 | Moore et al. . |
| 2,879,799 | 3/1959 | Jansen et al. . |
| 2,943,638 | 7/1960 | Prucha . |

(List continued on next page.)

FOREIGN PATENT DOCUMENTS

| | | |
|---|---|---|
| 2504615C2 | 5/1984 | (DE) . |
| 2257501 | 11/1975 | (FR) . |
| 2267501 | 11/1975 | (FR) . |
| 1 461 641 | 1/1977 | (GB) . |
| 1 598 863 | 9/1981 | (GB) . |
| 2073288A | 10/1981 | (GB) . |
| 2115461A | 9/1983 | (GB) . |
| 2292959A | 3/1996 | (GB) . |
| 296883 | 3/1971 | (SU) . |
| 570698 | 11/1977 | (SU) . |
| 651120 | 3/1979 | (SU) . |
| 933955 | 6/1982 | (SU) . |
| 1063985A | 12/1983 | (SU) . |
| 98/55732 | 12/1998 | (WO) . |
| 98/57029 | 12/1998 | (WO) . |
| WO 00/08299 | 2/2000 | (WO) . |

OTHER PUBLICATIONS

Thomas G. Hill, Jr. and Rashmi Bhavsar "Development of a Self–Equalizing Surface Controlled Subsurfaces Safety Valve for Reliability and Design Simplification" Offshore Technology Conference (1996).

P.G.T. Mason "Downhole High–Pressure Equalizing Safety Valves: A Solution–Variable Labyrinth Seals" Offshore Technology Conference (1987).

*Primary Examiner*—William Neuder
*Assistant Examiner*—Zakiya Walker
(74) *Attorney, Agent, or Firm*—Goldstein & Healey L.L.P.

(57) ABSTRACT

A subsurface valve with a pressure equalizing mechanism is provided to permit pressure above and below a valve closure member to equalize prior to the opening of the valve closure member. An actuating key is releasably engageable with a recess in a flow tube that is moveably disposed within a longitudinal bore of the safety valve. An equalizing plug is disposed for reciprocal movement within a plug bore, and is moveable in response to movement of the actuating key. To open the valve closure member, the flow tube moves downwardly into engagement with the actuating key, thereby carrying the actuating key into engagement with the equalizing plug to shift the equalizing plug to an open or equalizing position. Pressure above and below the valve closure member is equalized through the equalizing plug prior to the opening of the valve closure member by further downward movement of the flow tube.

23 Claims, 6 Drawing Sheets

U.S. PATENT DOCUMENTS

| | | | |
|---|---|---|---|
| 3,075,539 | | 1/1963 | Yoder . |
| 3,078,923 | | 2/1963 | Tausch . |
| 3,196,699 | | 7/1965 | Ipsen . |
| 3,382,895 | | 5/1968 | McCullough . |
| 3,405,730 | | 10/1968 | Baumann . |
| 3,442,484 | | 5/1969 | Carr et al. . |
| 3,485,270 | | 12/1969 | Freeman . |
| 3,631,888 | | 1/1972 | Anton et al. . |
| 3,788,595 | | 1/1974 | Colonna . |
| 3,799,204 | | 3/1974 | Watkins et al. . |
| 3,804,124 | | 4/1974 | Finke et al. . |
| 3,865,141 | | 2/1975 | Young . |
| 3,870,079 | | 3/1975 | Finke et al. . |
| 3,961,645 | | 6/1976 | Kagan . |
| 3,971,438 | | 7/1976 | Crowe . |
| 4,009,753 | | 3/1977 | McGill et al. . |
| 4,161,219 | | 7/1979 | Pringle . |
| 4,252,197 | | 2/1981 | Pringle . |
| 4,308,894 | | 1/1982 | Carpentier . |
| 4,362,214 | | 12/1982 | Pringle et al. . |
| 4,373,587 | | 2/1983 | Pringle . |
| 4,376,464 | | 3/1983 | Crow . |
| 4,411,316 | | 10/1983 | Carmody . |
| 4,415,036 | | 11/1983 | Carmody et al. . |
| 4,431,051 | * | 2/1984 | Adams, Jr. ..... 166/72 |
| 4,475,599 | | 10/1984 | Akkerman . |
| 4,478,286 | | 10/1984 | Fineberg . |
| 4,629,002 | | 12/1986 | Pringle . |
| 4,660,646 | | 4/1987 | Blizzard . |
| 4,926,945 | | 5/1990 | Pringle et al. . |
| 4,976,317 | | 12/1990 | Leismer . |
| 5,209,303 | * | 5/1993 | Barrington ..... 166/374 |
| 5,310,004 | | 5/1994 | Leismer . |
| 5,503,229 | | 4/1996 | Hill, Jr. et al. . |
| 5,682,921 | | 11/1997 | Rawson et al. . |

* cited by examiner

AXIAL EQUALIZING VALVE

RELATED APPLICATIONS

This application claims the benefit of U.S. Provisional Application No. 60/095,585, filed Aug. 6, 1998.

BACKGROUND OF THE INVENTION

1. Field of the Invention

The present invention relates to a subsurface safety valve used for controlling fluid flow in a well conduit and, more particularly, to an equalizing subsurface safety valve.

2. Description of the Related Art

Subsurface safety valves are commonly used in wells to prevent uncontrolled fluid flow through the well in the event of an emergency, such as to prevent a well blowout. Conventional safety valves use a flapper which is biased by a spring to a normally closed position, but is retained in an open position by the application of hydraulic fluid from the earth's surface. A typical subsurface safety valve is shown and described in U.S. Pat. No. 4,161,219, which is commonly assigned hereto.

When the flapper is in the closed position, well fluid pressure below the flapper acting upon a relatively large surface area of the flapper makes opening of the flapper difficult. This difficulty in opening cannot be easily overcome simply by increasing the force exerted against the flapper by an opening piston and cylinder assembly because the relatively small cross-sectional area of the opening piston and cylinder assembly would require a fluid pressure that may burst the control line carrying hydraulic fluid from the earth's surface to the piston and cylinder assembly. Additionally, when the flapper is opened the initial flow of well fluid is relatively rapid which tends to etch, or erode, the primary sealing surface of the flapper. Any damage to this primary sealing surface is extremely critical because it is this sealing surface which must be intact to prevent uncontrolled flow of well fluids and to prevent a possible well blow out. The present invention solves these difficulties by providing a subsurface safety valve with an equalizing mechanism to allow the pressure above and below the flapper to equalize prior to the complete opening of the flapper.

SUMMARY OF THE INVENTION

The present invention is directed generally to a subsurface safety valve with a pressure equalizing mechanism. In a broad aspect, the equalizing subsurface valve of the present invention may include a body member having a longitudinal bore extending therethrough; a valve closure member mounted within the body member to control fluid flow through the longitudinal bore; a valve actuator disposed within the body member and remotely shiftable to move the valve closure member between open and closed positions; an actuating key releasably engageable with the valve actuator and moveable in response to movement of the valve actuator when engaged therewith; and an equalizing plug disposed for reciprocal movement within a plug bore in the body member and along an axis generally parallel to the longitudinal bore in response to movement of the actuating key, the equalizing plug alternately permitting and preventing fluid communication between the longitudinal bore adjacent a first surface of the valve closure member and the longitudinal bore adjacent a second surface of the valve closure member. Another feature of this aspect of the invention is that the valve actuator includes a sleeve member disposed for movement within the longitudinal bore and a piston disposed within the body member and remotely shiftable to move the sleeve member within the longitudinal bore.

Another feature of this aspect of the invention is that the piston is a rod piston movably disposed within a cylinder in a side wall of the body member with one side of the piston adapted to be in communication with a source of hydraulic fluid for moving the sleeve member within the longitudinal bore. Another feature of this aspect of the invention is that the piston is an annular piston disposed about the sleeve member and is moveable in response to application of hydraulic fluid. Another feature of this aspect of the invention is that the actuating key includes a latching finger that is releasably engageable with a recess in the sleeve member. Another feature of this aspect of the invention is that the actuating key further includes an actuating surface, and an inclined surface disposed between the latching finger and the actuating surface, and the body includes an inclined diverting surface that cooperates with the inclined surface on the actuating key to disengage the latching finger from the recess in the valve actuator. Another feature of this aspect of the invention is that the actuating surface on the actuating key is disposed to contact the contact surface on the equalizing plug and shift the equalizing plug to an open position when the actuating key is engaged with and moved in response to movement of the valve actuator. Another feature of this aspect of the invention is that the recess includes a first latching surface inclined toward the first end of the body member, and the latching finger includes a second latching surface inclined toward the first end of the body to mate with the first latching surface when the latching finger is engaged with the recess. Another feature of this aspect of the invention is that the recess includes a first latching surface inclined toward a second end of the body member, and the latching finger includes a second latching surface inclined toward the second end of the body to mate with the first latching surface when the latching finger is engaged with the recess. Another feature of this aspect of the invention is that the recess includes a first latching surface substantially perpendicular to an outer surface of the valve actuator, and the latching finger includes a second latching surface substantially perpendicular to an inner surface of the actuating key to mate with the first latching surface when the latching finger is engaged with the recess. Another feature of this aspect of the invention is that the actuating key is biased against the valve actuator by a coil spring. Another feature of this aspect of the invention is that the actuating key is biased against the valve actuator by a leaf spring. Another feature of this aspect of the invention is that the actuating key is biased against the valve actuator by a Belleville washer. Another feature of this aspect of the invention is that the actuating key is biased against the valve actuator by a garter spring. Another feature of this aspect of the invention is that the actuating key is biased against the valve actuator by a C-spring. Another feature of this aspect of the invention is that the actuating key is biased against the valve actuator by an inclined contact surface of the equalizing plug. Another feature of this aspect of the invention is that the equalizing plug is a generally cylindrical plug having an internal fluid flow passageway therethrough and an annular sealing surface adjacent a first end thereof for cooperable sealing engagement with an annular sealing surface formed within the plug bore. Another feature of this aspect of the invention is that the annular sealing surface on the plug further includes a pliable annular sealing surface. Another feature of this aspect of the invention is that the annular sealing surface formed within the plug bore further includes a pliable annular sealing surface. Another feature of this aspect of the invention is that the internal fluid flow passageway includes a generally longitudinal passageway extending from a contact surface adjacent a second end of the plug and disposed in fluid communication with at least one radially-disposed opening, the at least one radially-disposed opening exiting the plug at a location between the contact surface and the annular sealing surface of the plug. Another feature of this aspect of the invention is that the valve may further include an annular housing having a series of baffles to induce a pressure drop as well fluids flow therepast so as to reduce erosion as the well fluids flow through the equalizing plug and reduce the amount of debris entrained in well bore fluids from flowing through the equalizing plug. Another feature of this aspect of the invention is that the equalizing plug is biased within the plug bore in a normally-closed position by a coil spring. Another feature of this aspect of the invention is that the equalizing plug is biased within the plug bore in a normally-closed position by a leaf spring. Another feature of this aspect of the invention is that the equalizing plug is biased within the plug bore in a normally-closed position by a Belleville washer. Another feature of this aspect of the invention is that the equalizing plug is biased within the plug bore in a normally-closed position by a garter spring. Another feature of this aspect of the invention is that the equalizing plug is biased within the plug bore in a normally-closed position by a C-spring.

In another aspect, the equalizing subsurface valve of the present invention may include: a body member having a longitudinal bore extending therethrough; a sleeve member disposed for movement within the longitudinal bore; a piston disposed within the body member and remotely shiftable to move the sleeve member within the longitudinal bore; a valve closure member mounted within the body member to control fluid flow through the longitudinal bore; an actuating key having a latching finger releasably engageable with a recess in the sleeve member and moveable in response to movement of the sleeve member when engaged therewith, the actuating key further including an inclined surface cooperable with an inclined diverting surface on the body to disengage the latching finger from the recess in the sleeve member; and an equalizing plug disposed for reciprocal movement within a plug bore in the body member and along an axis generally parallel to the longitudinal bore in response to movement of the actuating key, the equalizing plug alternately permitting and preventing fluid communication between the longitudinal bore adjacent a first surface of the valve closure member and the longitudinal bore adjacent a second surface of the valve closure member. Another feature of this aspect of the invention is that the valve may further include means for biasing the actuating key against the valve actuator. Another feature of this aspects of the invention is that the valve may further include means for biasing the equalizing plug within the plug bore. Another feature of this aspect of the invention is that the equalizing plug is a generally cylindrical plug having an internal fluid flow passageway therethrough and an annular sealing surface adjacent a first end thereof for co-operable sealing engagement with an annular sealing surface formed within the plug bore. Another feature of this aspect of the invention is that the annular sealing surface on the plug further includes a pliable annular sealing surface. Another feature of this aspect of the invention is that the annular sealing surface formed within the plug bore further includes a pliable annular sealing surface. Another feature of this aspect of the invention is that the internal fluid flow passageway includes a generally longitudinal passageway extending from a contact surface adjacent a second end of the plug and disposed in fluid communication with at least one radially-disposed opening, the at least one radially-disposed opening exiting the plug at a location between the contact surface and the aimular sealing surface of the plug.

In another aspect, the equalizing subsurface valve of the present invention may include: a body member having a longitudinal bore extending therethrough; a valve actuator disposed for movement within the longitudinal bore; means for controllably moving the valve actuator within the longitudinal bore; a valve closure member mounted within the body member to control fluid flow through the longitudinal bore; means for biasing the valve closure member to a normally-closed position to prevent fluid flow through the longitudinal bore; means for biasing the valve actuator away from the valve closure member; and pressure equalizing means releasably engageable with and responsive to movement of the valve actuator for permitting fluid pressure above and below the valve closure member to equalize before the valve closure member is opened to allow fluid flow through the longitudinal bore.

DETAILED DESCRIPTION OF THE INVENTION

For purposes of the following description, it will be assumed that the present invention is installed within a subsurface valve of the type shown in U.S. Pat. No. 4,161,219, which type is commonly referred to as a rod-piston safety valve. However, it should be understood that the present invention can be used in any commercially available subsurface valve, whether it be tubing conveyed, wireline conveyed, hydraulically operated, mechanically operated, or electrically operated.

Figure 1:
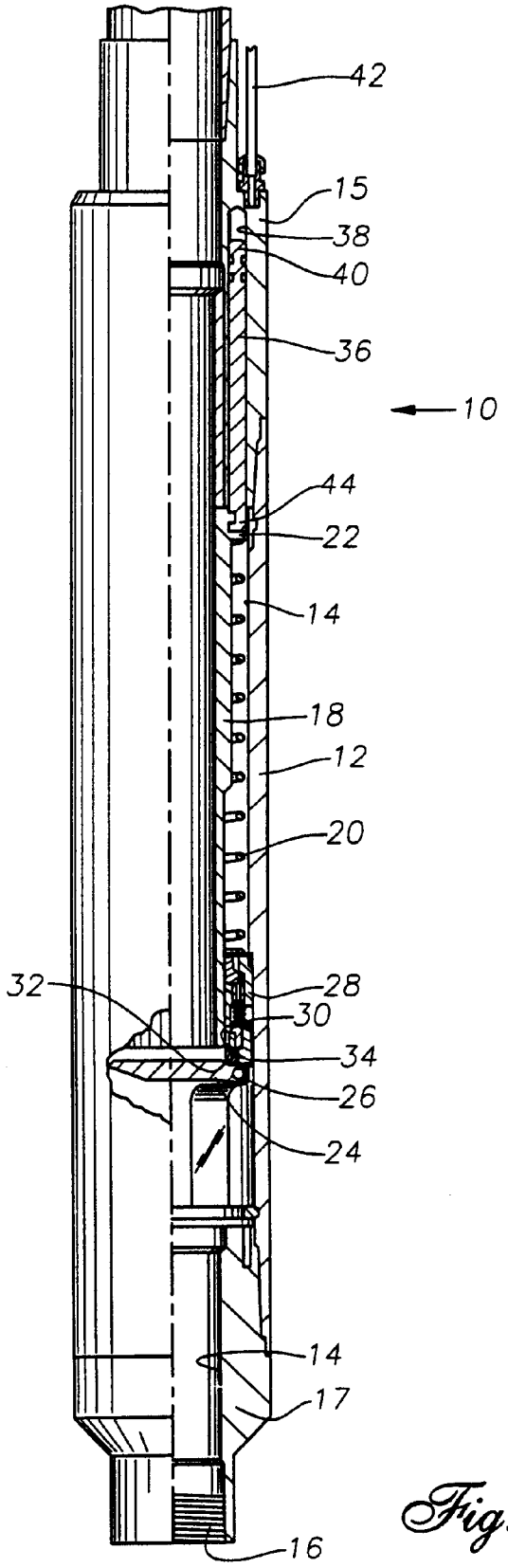
FIG. 1 is an elevational side view, partially in cross-section, showing a specific embodiment of the subsurface safety valve of the present invention.

Referring to the drawings in detail, wherein like numerals denote identical elements throughout the several views, there is shown, in FIG. 1 a specific embodiment of a subsurface valve 10 constructed in accordance with the present invention. With reference to FIG. 1, the subsurface valve 10 of this specific embodiment is comprised of a generally tubular body 12 having a longitudinal bore 14 extending therethrough, a first end 15, and a second end 17. Each end of the body 12 includes mechanisms, such as threads 16, for interconnection with a pipe string suspended within a wellbore (not shown). A sleeve member 18, sometimes also referred to as a flow tube, is disposed within the longitudinal bore 14 and is adapted for axial movement therein. A spring 20 is disposed around the flow tube 18 and acts upon a shoulder 22 on the flow tube 18 to bias the flow tube 18 away from a valve closure member 24, such as a flapper. The present invention is not intended to be limited to any particular means for biasing the flow tube 18 away from the flapper 24. For example, instead of, or in addition to, the spring 20, the valve 10 may utilize a balancing gas chamber (not shown), such as the types disclosed in U.S. Pat. Nos. 4,252,197 (Pringle), 4,660,646 (Blizzard), 4,976,317 (Leismer), and 5,310,004 (Leismer), all of which are commonly assigned hereto and incorporated herein by reference. Alternatively, the biasing means may be a control line (sometimes referred to as a balance line), either alone or in combination with one or more of the above-discussed return means, running from the earth's surface to force the flow tube 18 upwardly, such as disclosed in U.S. Pat. Nos. 4,495,998 and 4,621,695, which are commonly assigned hereto and incorporated herein by reference.

Figure 2:
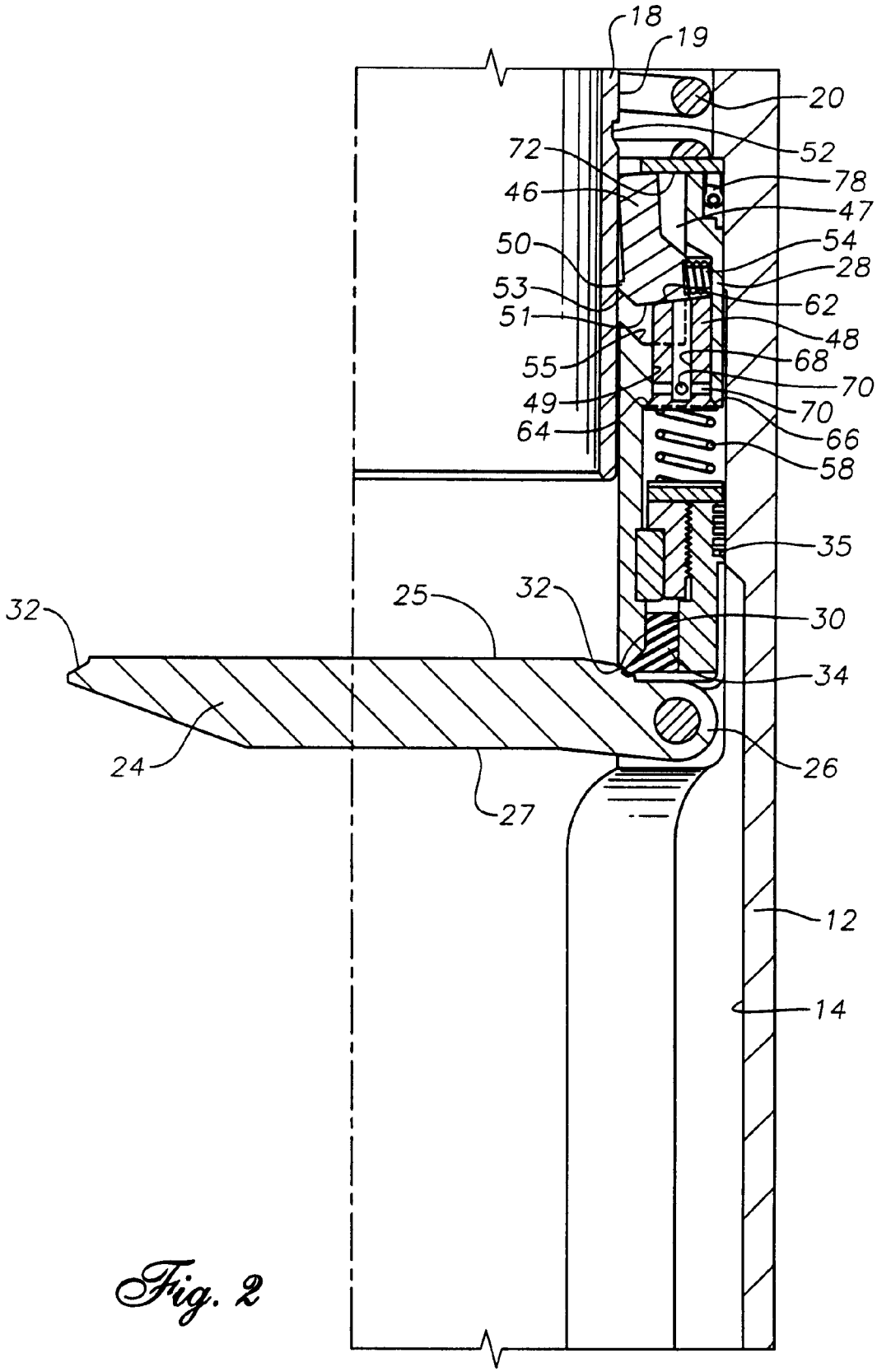
FIG. 2 is a fragmentary elevational side view, in cross-section, showing a specific embodiment of an equalizing plug installed in the subsurface safety valve shown in FIG. 1, with the equalizing plug and a flapper closure member in closed positions.
Figure 3:
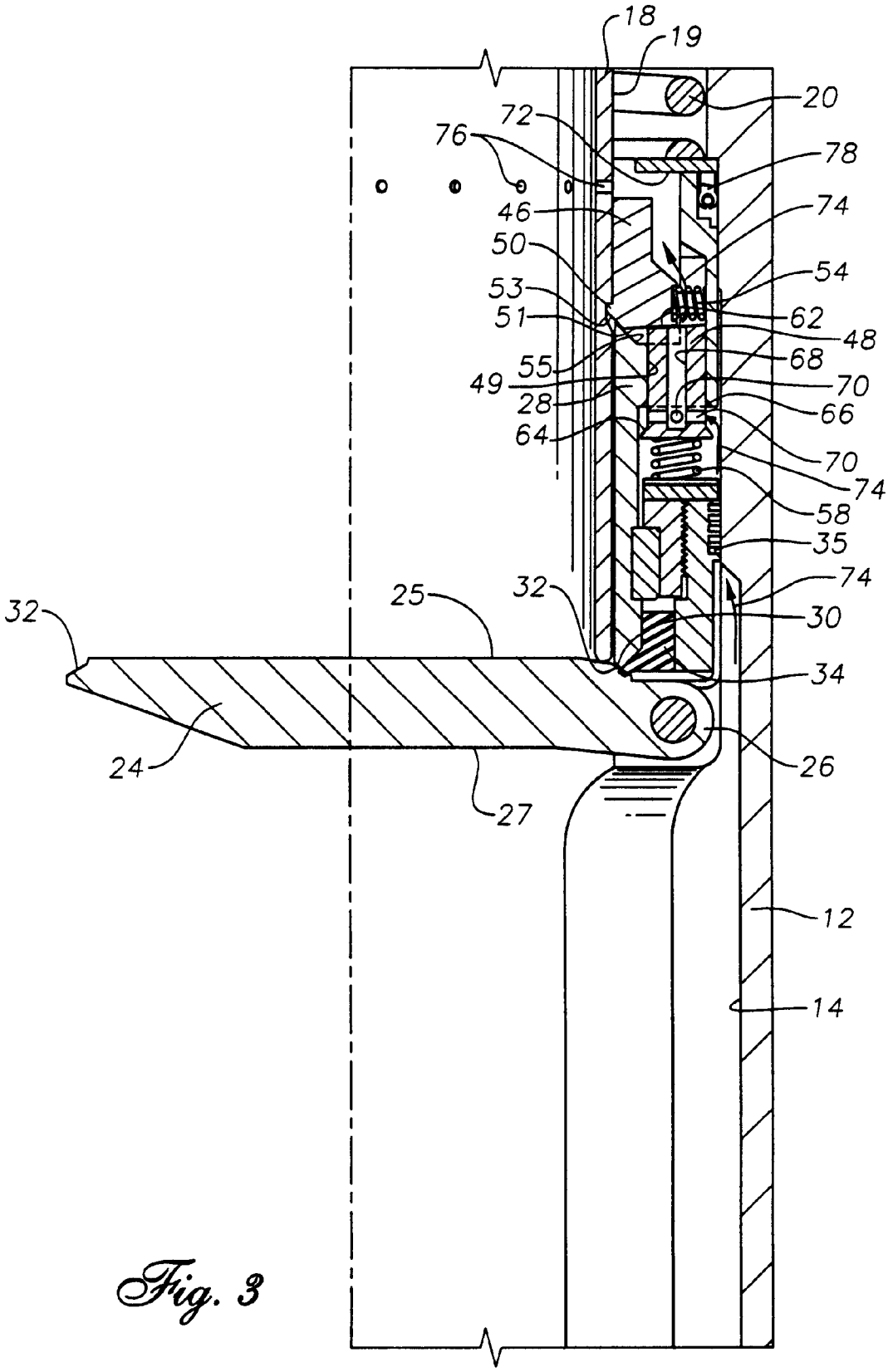
FIG. 3 is a fragmentary elevational view similar to FIG. 2, showing the flapper closure member still in its closed position, but the equalizing plug shifted to an open or pressure-equalizing position.
Figure 4:
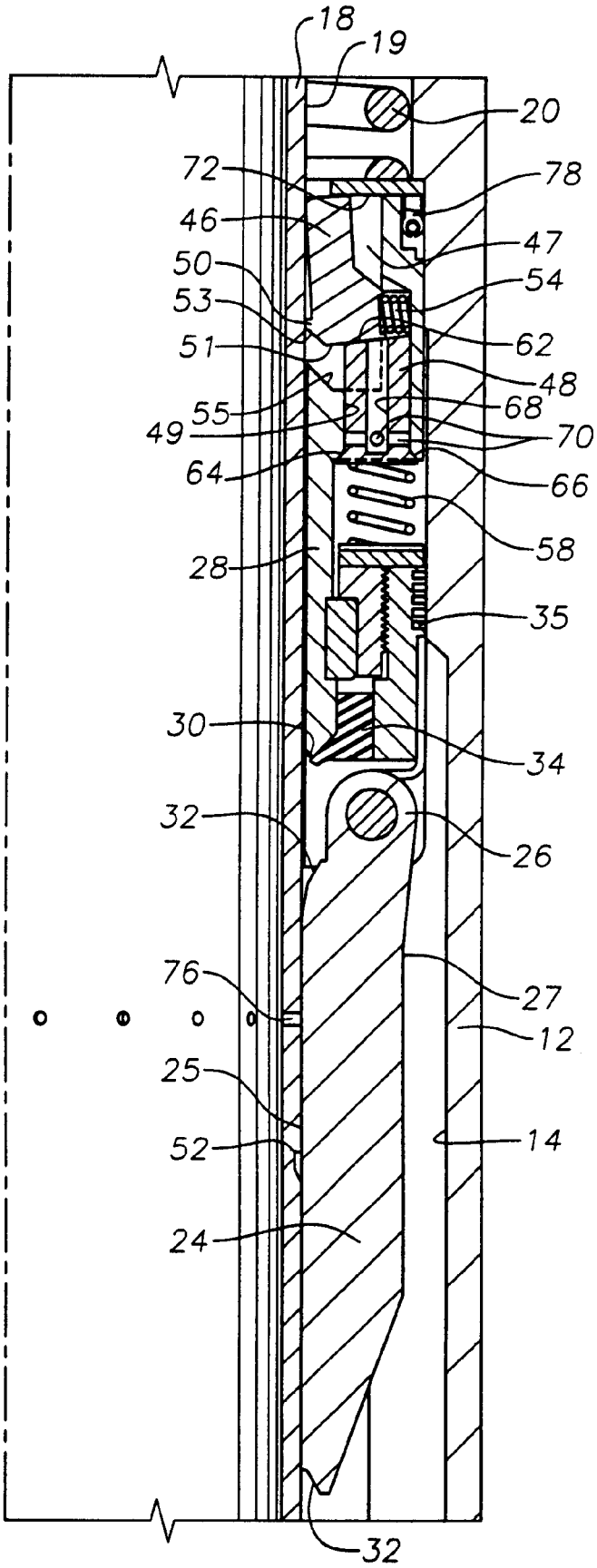
FIG. 4 is a fragmentary elevational view similar to FIGS. 2 and 3, showing the flapper closure member in a fully open position and the equalizing plug returned to its closed position.

As best shown in FIGS. 2–4, the flapper 24 includes an arm 26 on a peripheral edge thereof that is hingedly connected to an annular housing 28 mounted within the bore 14. The flapper 24 further includes a first surface 25 and a second surface 27. In a specific embodiment, the annular housing 28 may include a metallic annular sealing surface 30 co-operable with an annular sealing surface 32 on the flapper 24. In a specific embodiment, the annular housing 28 may further include a secondary annular sealing surface 34 formed from an annular body of pliable material, which is co-operable with the annular sealing surface 32 on the flapper 24. The metallic sealing surface 30 is generally referred to as the "hard seat" and the pliable sealing surface 34 is generally referred to as the "soft seat". In addition, the housing 28 may include a series of baffles or grooves 35 located on an exterior surface of the housing 28 and between the housing 28 and the longitudinal bore 14 of the body 12, the purpose of which will be explained below.

A valve actuator is provided within the body 12 and is remotely shiftable to permit an operator at the earth's surface to remotely open and close the flapper 24. The present invention is not limited to any particular type of valve actuator. In a specific embodiment, the valve actuator may include the flow tube 18 that is disposed for movement within the longitudinal bore 14 and a piston that is remotely shiftable to move the flow tube 18 within the longitudinal bore to open and close the flapper 24. This embodiment may include any type of piston (e.g., rod-piston, annular, etc.). In a specific embodiment, as shown in FIG. 1, a rod-piston system may be provided to open the flapper 24, and may be comprised of a piston 36 sealably mounted for reciprocal movement within a cylinder 38 located within the wall of the tubular body 12. A first end 40 of the piston 36 is in communication with hydraulic fluid (not shown) provided thereto from the earth's surface through a relatively small diameter control conduit 42. A second end 44 of the piston 36 may be operatively connected, in any suitable manner, to the flow tube 18. When the pressure of hydraulic fluid in the control conduit 42 exceeds the force needed to compress the spring 20 (and/or gas charge, balance line, etc.), the piston 36 is forced downwardly, thereby causing the flow tube 18 to move downwardly to come into contact with, and open, the flapper 24. In the event that the hydraulic pressure applied to the piston 36 is decreased, as by command from the earth's surface or by the control conduit 42 being damaged, the spring 20 (and/or gas charge, balance line, etc.) forces the flow tube 18 upwardly away from the flapper 24. The flapper 24 is then rotated, and biased, into a closed position by action of a hinge spring (not shown) and/or well bore fluids to permit the annular sealing surfaces 30, 32 and 34 to mate and thereby establish a fluid seal to prevent fluid flow into the flow tube 18. As noted above, in the specific embodiment in which the valve actuator includes a flow tube 18 and a piston, the present invention is not limited to any particular type of piston. For purposes of illustration only, the subsurface valve shown in FIG. 1 uses hydraulic pressure applied through the control line 42 to a rod-piston assembly to move the flow tube 18. Other types of subsurface valves are within the scope of the present invention, including but not limited to, for example, valves which apply hydraulic pressure in the control line 42 to an annular piston disposed about the flow tube 18, in a manner known to those of skill in the art. In other specific embodiments, the valve actuator may be mechanically or electrically operated, in a manner well known to those of skill in the art.

As has been described above, when the flapper 24 has been closed, the pressure of fluids within the bore 14 upstream of (i.e., below) the closed flapper 24 increases and the pressure of the wellbore fluids downstream of (i.e., above) the closed flapper 24 decreases as the wellbore fluids remaining above the flapper 24 are recovered to the earth's surface through the pipe string. This may create a large pressure differential across the flapper 24 such that reopening of the flapper 24 becomes difficult. This difficulty in opening the flapper 24 cannot be easily overcome simply by increasing the force exerted against the flapper 24 by the flow tube 18, because the relatively small cross-sectional area of the opening piston 36 would require a fluid pressure that may burst the control conduit 42 carrying the hydraulic fluid. The present invention solves this difficulty in opening the flapper 24 by providing a pressure-equalizing mechanism, described below, to allow the pressure above and below the flapper 24 to equalize prior to opening of the flapper 24, thereby reducing the force necessary to open the flapper 24.

Figure 5:
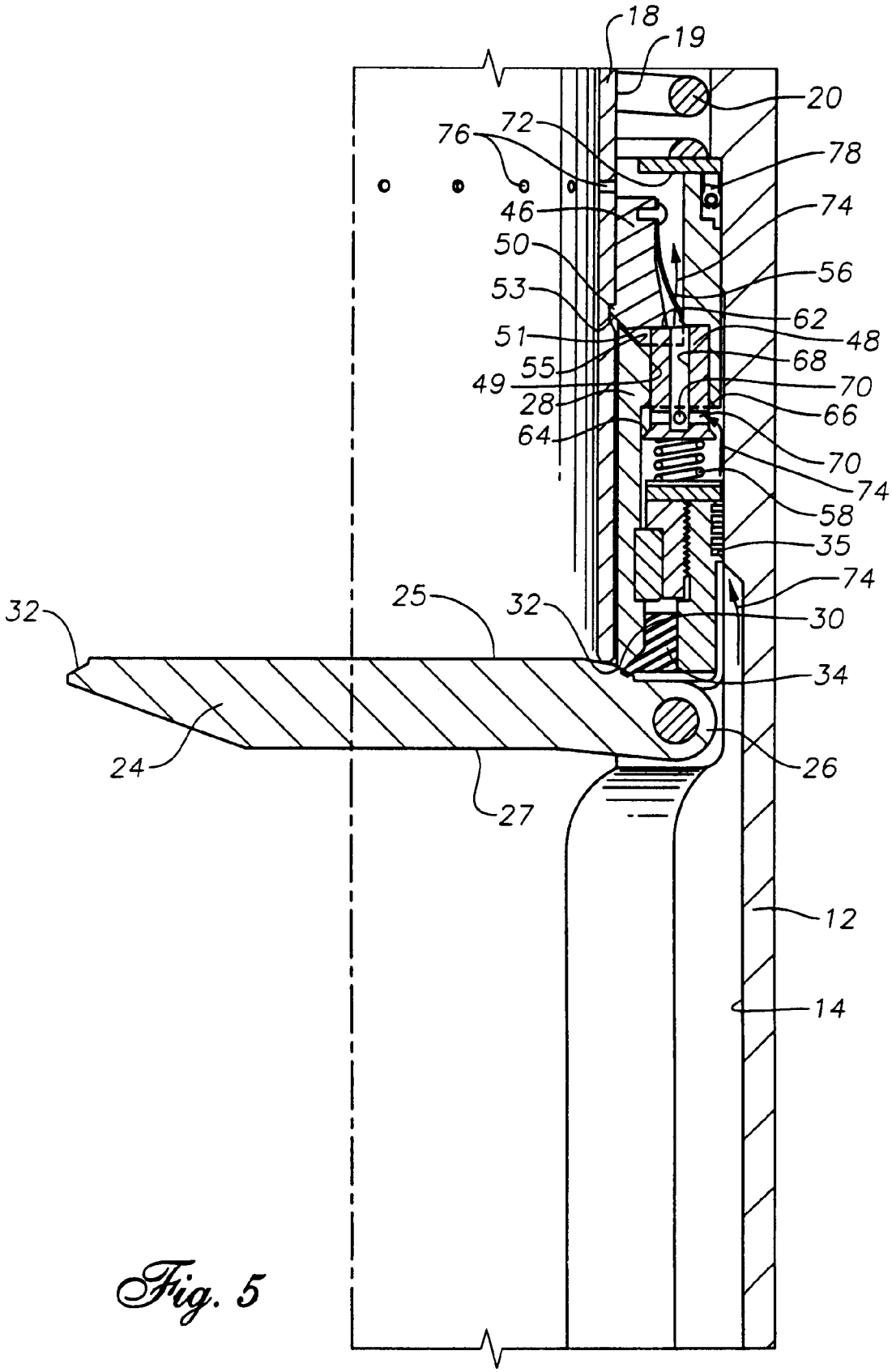
FIG. 5 is an elevational side view, partially in cross-section, showing the use of a leaf spring to bias an actuating key against a flow tube.

The pressure-equalizing mechanism of the present invention will now be described. Referring to FIG. 2, the valve 10 includes an actuating key 46 that is releasably engageable with the flow tube 18 and moveable in response to movement of the flow tube 18. The valve 10 further includes an equalizing plug 48 disposed for reciprocal movement within a plug bore 49 in the body 12 (or in the annular housing 28) and along an axis generally parallel to the longitudinal bore 14 in response to movement of the actuating key 46. The equalizing plug 48 alternately permits and prevents fluid communication between the longitudinal bore 14 adjacent the first surface 25 of the flapper 24 and the longitudinal bore 14 adjacent the second surface 27 of the flapper 24 when the flapper 24 is in its closed position, as will be more fully explained below. The actuating key 46 is disposed within a space 47 formed by the annular housing 28. The actuating key 46 includes a latching finger 50 that is releasably engageable with a recess 52 in an outer surface 19 of the flow tube 18. The actuating key 46 includes an actuating surface 51, and an inclined surface 53 disposed between the latching finger 50 and the actuating surface 51. The body 12, or annular housing 28, includes an inclined diverting surface 55 that cooperates with the inclined surface 53 on the actuating key 46 to disengage the latching finger 50 from the flow tube recess 52 after pressure above and below the flapper 24 has been equalized through the equalizing plug 48, as will be more fully explained below. The actuating key 46 is biased against the outer surface 19 of the flow tube 18 by a key-biasing means, which, in a specific embodiment may be a coil spring 54, as shown in FIGS. 2–4. However, the present invention is not limited to any particular key-biasing means. For example, in another specific embodiment, the key-biasing means may be a leaf spring 56, as shown in FIG. 5. In a specific embodiment, the leaf spring 56 may be connected to the actuating key 46, as shown in FIG. 5. In another specific embodiment, the leaf spring 56 may be connected to the valve body 12. In another specific embodiment, the key-biasing means may be a Belleville washer. In another specific embodiment, the key-biasing means may be an upper inclined surface of the equalizing plug 48, as will be more fully explained below. In another specific embodiment, the key-biasing means may be a garter spring. In another specific embodiment, the key-biasing means may be a C-spring.

Figure 6:
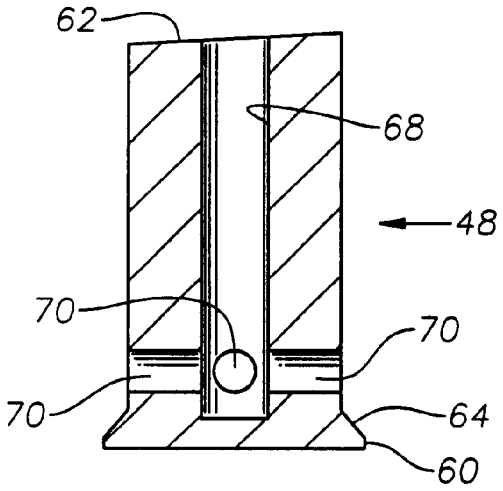
FIG. 6 is an elevational side view, in, cross-section, of a specific embodiment of the equalizing plug of the present invention.

The equalizing plug 48 is held in a normally-closed position within the plug bore 49 by action of a plug-biasing means, which, in a specific embodiment may be a coil spring 58. As with the key-biasing means discussed above, the present invention is not limited to any particular type of plug-biasing means, but instead may be a leaf spring, a Belleville washer, a garter spring, a C-spring, etc. As best shown in FIG. 6, the equalizing plug 48 may be a generally cylindrical plug and may include an enlarged shoulder 60 on a first end thereof and a contact surface 62 on an opposite or second end thereof. In a specific embodiment, the contact surface 62 may be flat or substantially perpendicular to a longitudinal axis of the plug 48. In another specific embodiment, the contact surface 62 may be slightly inclined toward the flow tube 18, such as, for example, at an angle in the range of 5 to 10 degrees, to bias the latching finger 50 in the flow tube recess 52 (see FIGS. 2–4). The enlarged shoulder 60 on the plug 48 may include a metallic annular sealing surface 64 that mates with a metallic annular sealing surface 66 (or "hard seat") disposed about the plug bore 49 (see FIGS. 2–4). In a specific embodiment, the metallic annular sealing surface 64 on the enlarged shoulder 60 may include a secondary annular sealing surface (or "soft seat") (not shown) formed from an annular body of pliable material. Similarly, in another specific embodiment, the metallic annular sealing surface 66 on the plug bore 49 may include a secondary annular sealing surface (or "soft seat") (not shown) formed from an annular body of pliable material. Preferably, a soft seat is used to ensure sealing when operating in low pressure differential applications. The equalizing plug 48 has an internal fluid passageway therethrough, and, more specifically, may include a generally longitudinal passageway 68 extending from the contact surface 62 of the plug 48 that is in fluid communication with at least one generally radially-disposed opening 70 that exits the equalizing plug 46 at a location between the contact surface 62 and the sealing surface 64 on the plug shoulder 60. The purpose of the passageway 68 and the openings 70 will become apparent from the following description of the operation of the equalizing mechanism of the present invention.

With reference to FIG. 2, the flapper 24 and the equalizing plug 48 are shown in their closed positions so as to restrict flow through the longitudinal bore 14 and the plug bore 49, respectively. The actuating key 46 is shown biased upwardly by action of the plug-biasing means (e.g., spring 58), and the latching finger 50 is shown biased against the outer surface 19 of the flow tube 18 by the key-biasing means (e.g., spring 54) and disengaged from the flow tube recess 52. A ledge 72 on the body 12 (or housing 28) may be provided to assist in retaining the actuating key 46 within the space 47 formed by the housing 28. When it is desired to open the flapper 24, the flow tube 18 is forced towards the flapper 24 by the application of hydraulic fluid through the control conduit 42 (as has been described previously) or by electrical/mechanical action or simply mechanical action, depending upon the type of safety valve within which the present invention is included. As the flow tube 18 is moved towards the flapper 24 from the position shown in FIG. 2, the latching finger 50 will become biased into engagement with the flow tube recess 52 under force of the key-biasing means (e.g., spring 54). Continued downward movement of the flow tube 18 after engagement of the latching finger 50 and the flow tube recess 52 will result in downward movement of the actuating key 46. As shown in FIG. 3, the flow tube 18 is moved downwardly into contact with the first surface 25 of the flapper 24, thereby moving the actuating key 46 downwardly to shift the plug 48 downwardly within the plug bore 49. In this manner, the annular sealing surfaces 64 and 66 on the plug 48 and plug bore 49, respectively, are separated, thereby exposing the at least one radially-disposed openings 70 (see also FIG. 6). The relatively high pressure wellbore fluid below the flapper 24 will then flow, as indicated by arrows 74, past the series of baffles or grooves 35, into the at least one radially-disposed opening 70 in the plug 48, through the longitudinal passageway 68 in the plug 48, and into the longitudinal bore 14 above the flapper 24, such as through apertures 76 in the flow tube 18. The series of baffles or grooves 35 operate to induce a pressure drop so as to reduce erosion as the well fluids flow through the equalizing plug 48, and also reduce the amount of debris (e.g., sand) that may be entrained in the fluids from flowing through the equalizing plug 48. Since the radially-disposed openings 70 are displaced from the annular sealing surfaces 64 and 66, the relatively rapid flow of wellbore fluids will not damage the sealing surfaces 64 and 66. In this manner, an internal fluid flow passageway is opened through the plug 48, thereby permitting the fluid pressure above and below the flapper 24 to equalize prior to opening the flapper 24. The valve 10 is provided with a seal 78 between the housing 28 and the body 12 to prevent fluid flow from below to above the flapper 24 when the plug 48 is closed. The flow tube 18 may be formed from material sufficiently hard to not be deformed, or galled, by contact with the latching finger 50, or the portion of the flow tube 18 that experiences contact with the latching finger 50 may include a hard coating.

After the pressure has equalized above and below the flapper 24, the flow tube 18 is moved further downwardly so as to cause the inclined surface 53 on the actuating key 46 to come into contact with and move along the inclined diverting surface 55 on the housing 28. Continued downward movement of the flow tube 18 will move the inclined surface 53 on the actuating key 46 along the inclined diverting surface 55 on the housing, and will also cause the actuating surface 51 on the lower end of the actuating key 46 to slide along the contact surface 62 on the upper end of the plug 48. In this manner, as the flow tube 18 rotates the flapper 24 towards its open position, the latching finger 50 on the actuating key 46 will become disengaged from the flow tube recess 52, at which time the equalizing plug 48 will be forced upwardly within the plug bore 49 under force of the plug-biasing means (e.g., spring 58) so as to close the at least one radially-disposed opening 70 and bring the sealing surfaces 64 and 66 into operative contact with each other to prevent fluid flow therepast.

In this manner, the pressure differential across the flapper 24 is equalized through the plug 48 prior to the opening of the flapper 24. As such, the equalizing mechanism of the present invention prevents the initial relatively high velocity flow of fluids past the flapper 24 from damaging the annular sealing surfaces 30, 32, and 34. To complete the opening of the flapper 24, the flow tube 18 is forced against the flapper 24 with sufficient force to overcome the force exerted by the hinge spring (not shown), the force exerted by the flow-tube return means (e.g., spring 20, gas charge, balance line, etc.) and the force exerted by the pressure in the tubing below the flapper 24. The flow tube 18 pushes the flapper 24 open and holds it in the open position, as shown in FIG. 4, for so long as the hydraulic pressure from the control conduit 42 (or other force, depending on the type of subsurface valve) is applied. When the hydraulic pressure from the control conduit 42 (or other force) is reduced or removed, the return means (e.g., the spring 20) will cause the flow tube 18 to be moved away from the flapper 24 so that the flapper 24 will rotate to a closed position and the sealing surfaces 30, 32 and 34 will come into operative contact with each other to prevent fluid flow therepast.

Figure 7:
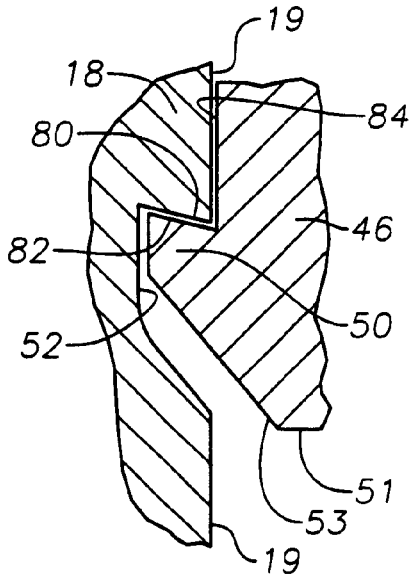
FIG. 7 is an elevational side view, in cross-section, of a specific embodiment of a flow tube recess and a mating latching finger on an actuating key.
Figure 8:
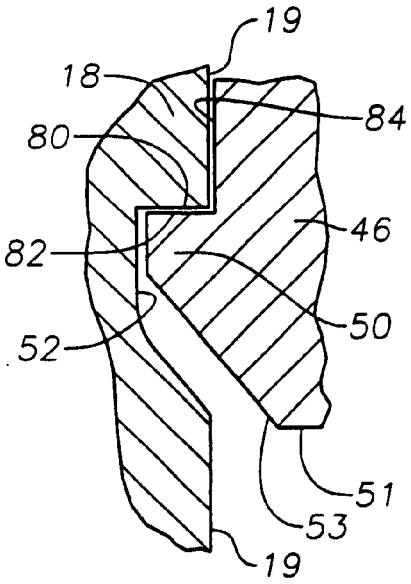
FIG. 8 is an elevational side view, in cross-section, similar to FIG. 7, of another specific embodiment of the flow tube recess and mating latching finger on the actuating key.
Figure 9:
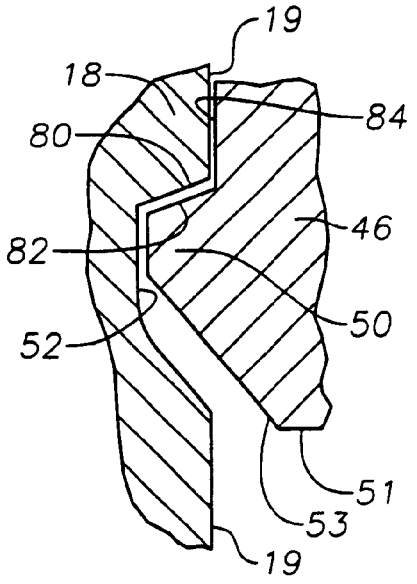
FIG. 9 is an elevational side view, in cross-section, similar to FIGS. 7 and 8, of another specific embodiment of the flow tube recess and mating latching finger on the actuating key.

Alternative embodiments of the latching finger 50 and the flow tube recess 52 will now be described with reference to FIGS. 7–9, each of which illustrates a first latching surface 80 on the flow tube recess 52 and a second latching surface 82 on the latching finger 50. As shown in FIG. 7, in a specific embodiment, the first latching surface 80 may be inclined toward the first end 15 of the body 12 (see FIG. 1), and the second latching surface 82 may likewise be inclined toward the first end 15 of the body 12 so as to mate with the first latching surface 80 when the latching finger 50 is engaged with the flow tube recess 52. In another specific embodiment, as shown in FIG. 8, the first latching surface 80 may be substantially perpendicular to the outer surface 19 of the flow tube 18, and the second latching surface 82 may be substantially perpendicular to an inner surface 84 of the actuating key 46 so as to mate with the first latching surface 80 when the latching finger 50 is engaged with the flow tube recess 52. In another specific embodiment, as shown in FIG. 9, the first latching surface 80 may be inclined toward the second end 17 of the body 12 (see FIG. 1), and the second latching surface 82 may likewise be inclined toward the second end 17 of the body 12 so as to mate with the first latching surface 80 when the latching finger 50 is engaged with the flow tube recess 52. As to the embodiments shown in FIGS. 7 and 9, which depict the surfaces 80 and 82 as being inclined, the angle of the incline from a line perpendicular to the outer surface 19 of the flow tube 18 or to the inner surface 84 of the actuating key 46 may, in a specific embodiment, fall into the range of 5 to 10 degrees.

In view of the above description, it can now be readily seen that the safety valve of the present invention has a number of advantages. For example, the plug 48 is maintained in its open position for a relatively brief period of time X the plug 48 is open only when the latching finger 50 on the actuating key 46 is engaged with the flow tube recess 52 and the actuating key 46 is holding the plug 48 in its equalizing position. As soon as the well bore pressure equalizes above and below the flapper 24, the flow tube 18 is free to move downwardly to disengage the latching finger 50 from the flow tube recess 52, and thereby permit the plug 48 to move to its closed position. In this manner, excessive exposure of the sealing surface 64 on the plug 48 and the sealing surface 66 on the plug bore 49 to production fluids is prevented. It is further noted that the plug 48 will be maintained in its closed position during the process of moving the flapper 24 from its fully-open position, as shown in FIG. 4, to its fully-closed position, as shown in FIG. 2. Another advantage of the equalizing mechanism of the present invention is that there are negligible side or transverse loads imparted to the flow tube 18 by the plug 48 during the process of shifting the equalizing plug 48 to its open or equalizing position, as shown in FIG. 3. Because the plug bore 49 is generally parallel to the longitudinal bore 14, the force that is applied to the plug 48 by high-pressure well bore fluids, which must be overcome in order to open the plug 48, is likewise generally parallel to the longitudinal bore 14, as opposed to being transverse to the longitudinal bore 14, as is the case with some previous pressure-equalizing subsurface valves, such as, for example, U.S. Pat. No. 5,503,229 (Hill, Jr. et al.). As such, the force applied to the plug 48 by the well bore pressure does not translate into a transverse force on the flow tube 18, which can cause deformation of the flow tube 18. This elimination of significant side loads further minimizes friction on the flow tube 18.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. An equalizing subsurface valve for controlling fluid flow in a well conduit, comprising:

a body member having a longitudinal bore extending therethrough and an inclined diverting surface;

a valve closure member mounted within the body member to control fluid flow through the longitudinal bore;

a valve actuator disposed within the body member and remotely shiftable to move the valve closure member between open and closed positions, the valve actuator including a sleeve member disposed for movement within the longitudinal bore and a piston disposed within the body member and remotely shiftable to move the sleeve member within the longitudinal bore;

an actuating key having a latching finger releasably engageable with a recess in the valve actuator, an actuating surface, and an inclined surface disposed between the latching finger and the actuating surface, the actuating key being releasably engageable with the valve actuator and moveable in response to movement of the valve actuator when engaged therewith, the inclined surface on the actuating key cooperating with the inclined diverting surface on the body to disengage the latching finger from the recess in the valve actuator; and an equalizing plug disposed for reciprocal movement within a plug bore in the body member and along an axis generally parallel to the longitudinal bore in response to movement of the actuating key, the equalizing plug alternately permitting and preventing fluid communication between the longitudinal bore adjacent a first surface of the valve closure member and the longitudinal bore adjacent a second surface of the valve closure member.

2. The equalizing subsurface safety valve of claim 1, wherein the piston is a rod piston movably disposed within a cylinder in a side wall of the body member with one side of the piston adapted to be in communication with a source of hydraulic fluid for moving the sleeve member within the longitudinal bore.

3. The equalizing subsurface valve of claim 1, wherein the actuating surface on the actuating key is disposed to contact a contact surface on the equalizing plug and shift the equalizing plug to an open position when the actuating key is engaged with and moved in response to movement of the valve actuator.

4. The equalizing subsurface valve of claim 1, wherein the recess includes a first latching surface inclined toward a first end of the body member, and the latching finger includes a second latching surface inclined toward the first end of the body to mate with the first latching surface when the latching finger is engaged with the recess.

5. The equalizing subsurface valve of claim 1, wherein the recess includes a first latching surface inclined toward a second end, of the body member, and the latching finger includes a second latching surface inclined toward the second end of the body to mate with the first latching surface when the latching finger is engaged with the recess.

6. The equalizing subsurface valve of claim 1, wherein the recess includes a first latching surface substantially perpendicular to an outer surface of the valve actuator, and the latching finger includes a second latching surface substantially perpendicular to an inner surface of the actuating key to mate with the first latching a surface when the latching finger is engaged with the recess.

7. The equalizing subsurface valve of claim 1, wherein the actuating key is biased against the valve actuator by a coil spring.

8. The equalizing subsurface valve of claim 1, wherein the actuating key is biased against the valve actuator by a leaf spring.

9. The equalizing subsurface valve of claim 1, wherein the actuating key is biased against the valve actuator by an inclined contact surface of the equalizing plug.

10. The equalizing subsurface valve of claim 1, wherein the equalizing plug is a generally cylindrical plug having an internal fluid flow passageway therethrough and an annular sealing surface adjacent a first end thereof for co-operable sealing engagement with an annular sealing surface formed within the plug bore.

11. The equalizing subsurface valve of claim 10, wherein the annular sealing surface on the plug further includes a pliable annular sealing surface.

12. The equalizing subsurface valve of claim 10, wherein the annular sealing surface formed within the plug bore further includes a pliable annular sealing surface.

13. The equalizing subsurface valve of claim 10, wherein the internal fluid flow passageway includes a generally longitudinal passageway extending from a contact surface adjacent a second end of the plug and disposed in fluid communication with at least one radially-disposed opening, the at least one radially-disposed opening exiting the plug at a location between the contact surface and the annular sealing surface of the plug.

14. The equalizing subsurface valve of claim 1, further including an annular housing having a series of baffles to induce a pressure drop as well fluids flow therepast so as to reduce erosion as the well fluids flow through the equalizing plug and reduce the amount of debris entrained in well bore fluids from flowing through the equalizing plug.

15. The equalizing subsurface valve of claim 1, wherein the equalizing plug is biased within the plug bore in a normally-closed position by a coil spring.

16. An equalizing subsurface valve for controlling fluid flow in a well conduit, comprising:

a body member having a longitudinal bore extending therethrough;

a sleeve member disposed for movement within the longitudinal bore;

a piston disposed within the body member and remotely shiftable to move the sleeve member within the longitudinal bore;

a valve closure member mounted within the body member to control fluid flow through the longitudinal bore;

an actuating key having a latching finger releasably engageable with a recess in the sleeve member and moveable in response to movement of the sleeve member when engaged therewith, the actuating key further including an inclined surface co-operable with an inclined diverting surface on the body to disengage the latching finger from the recess in the sleeve member; and an equalizing plug disposed for reciprocal movement within a plug bore in the body member and along an axis generally parallel to the longitudinal bore in response to movement of the actuating key, the equalizing plug alternately permitting and preventing fluid communication between the longitudinal bore adjacent a first surface of the valve closure member and the longitudinal bore adjacent a second surface of the valve closure member.

17. The equalizing subsurface valve of claim 16, further including means for biasing the actuating key against the valve actuator.

18. The equalizing subsurface valve of claim 16, further including means for biasing the equalizing plug within the plug bore.

19. The equalizing subsurface valve of claim 16, wherein the equalizing plug is a generally cylindrical plug having an internal fluid flow passageway therethrough and an annular sealing surface adjacent a first end thereof for co-operable sealing engagement with an annular sealing surface formed within the plug bore.

20. The equalizing subsurface valve of claim 19, wherein the annular sealing surface on the plug further includes a pliable annular sealing surface.

21. The equalizing subsurface valve of claim 19, wherein the annular sealing surface formed within the plug bore further includes a pliable annular sealing surface.

22. The equalizing subsurface valve of claim 21, wherein the internal fluid flow passageway includes a generally longitudinal passageway extending from a contact surface adjacent a second end of the plug and disposed in fluid communication with at least one radially-disposed opening, the at least one radially-disposed opening exiting the plug at a location between the contact surface and the annular sealing surface of the plug.

23. An equalizing subsurface valve for controlling fluid flow in a well conduit, comprising:

a body member having a longitudinal bore extending therethrough;

a valve closure member mounted within the body member to control fluid flow through the longitudinal bore;

a valve actuator disposed within the body member and remotely shiftable to move the valve closure member between open and closed positions;

an equalizing plug disposed for reciprocal movement within a plug bore in the body member and along an axis generally parallel to the longitudinal bore in response to movement of the valve actuator, the plug bore being laterally spaced from the valve actuator, the equalizing plug alternately permitting and preventing fluid communication between the longitudinal bore adjacent a first surface of the valve closure member and the longitudinal bore adjacent a second surface of the valve closure member, the equalizing plug having an inclined contact surface; and an actuating key biased against the valve actuator by the inclined surface of the equalizing plug, releasably engageable with the valve actuator and moveable in response to movement of the valve actuator when engaged therewith.

* * * * *